United States Patent [19]

Sasakawa et al.

[11] Patent Number: 4,838,544

[45] Date of Patent: Jun. 13, 1989

[54] EXERCISE BICYCLE

[75] Inventors: Kazumasa Sasakawa, Minoo; Hisao Nishimura, Kitakatsuragi; Kensuke Fujiwaka, Kashiwara, all of Japan

[73] Assignee: Matsushita Electric Industrial Co., Ltd., Kadoma, Japan

[21] Appl. No.: 102,469

[22] Filed: Sep. 29, 1987

[30] Foreign Application Priority Data

Jun. 23, 1987 [JP] Japan ..... 62-155895

[51] Int. Cl.[4] ..... A63B 21/00

[52] U.S. Cl. ..... 272/73

[58] Field of Search ..... 272/73, 71, 72, 97, 272/116, 131, 132, 134; 74/47, 48; 128/25 R, 25 B

[56] References Cited

U.S. PATENT DOCUMENTS

| | | | |
|---|---|---|---|
| 326,247 | 9/1885 | Root | 272/73 |
| 3,940,128 | 2/1976 | Ragone . | |
| 4,188,030 | 2/1980 | Hooper | 272/73 |
| 4,602,781 | 7/1986 | La Marsh et al. | 272/73 |
| 4,657,244 | 4/1987 | Ross | 272/73 |
| 4,712,789 | 12/1987 | Brilando | 272/73 |
| 4,712,790 | 12/1987 | Szymski | 272/73 |

FOREIGN PATENT DOCUMENTS

| | | | |
|---|---|---|---|
| 517774 | 1/1931 | Fed. Rep. of Germany . | |
| 120015 | 8/1970 | Norway | 272/73 |

*Primary Examiner*—Richard J. Apley
*Assistant Examiner*—S. R. Crow
*Attorney, Agent, or Firm*—Cushman, Darby & Cushman

[57] ABSTRACT

An exercise bicycle for exercising the arms and the legs or for exercising the arms independently of the legs is provided wherein a pedal shaft supporting pedal cranks for transmitting motion of the legs is transmitted to an intermediate shaft through a one-way clutch. The intermediate shaft, handle bars and a flywheel are connected to one another. Further, a load applying device is provided as a braking structure which makes use of eddy currents of magnets so as to minimize an initial resistance at the start of exercise and to increase the braking load as the rotational speed of the wheel increases.

3 Claims, 3 Drawing Sheets

EXERCISE BICYCLE

FIELD OF THE INVENTION AND RELATED ART STATEMENT

1. Field of the Invention

The present invention relates to an exerciser and, more particularly, to a bicycle-type exerciser for exercising the users arms and legs.

2. Description of the Related Art

Bicycle-type exercisers have heretofore been used primarily for exercising the legs. The reason for the use of such exercisers is based on the theory that exercise of leg muscles, particularly femoral muscles, which require the most blood and oxygen can exert an effective load on the heart and, thus, is the best exercise for strengthening the heart-lung function.

Such a method of exercise, however, is disadvantageous as the leg muscles often fatigue before an effective load is exerted on the heart.

Other exercisers have been developed which enable exercise of not only the legs but also the arms. An example of such an exerciser is disclosed in German Patent Specification No. 517774. The exercisers which permit simultaneous exercise of arms and legs each comprise a rotating wheel, means for braking the wheel, a pedal shaft to be rotated by motion of the legs, a second shaft to be rotated by motion of the arms, and means for transmitting rotation of the pedal shaft and second shaft to the wheel.

With such a structure, however, always transmitted between the wheel pedals and handles. Therefore, even when it is desired to only exercise the arms and not the legs, the motion of the handles inevitably actuates the pedals and thus does not permit the legs to rest. Thus, the pedals are uselessly rotated even when exercise of the arms alone is desired and there is the risk that the legs may be stricken by the pedals when the feet are not resting thereupon.

Further, in some exercisers of this type, an ordinary hand brake is used for exerting a braking load on the wheel. In such a configuration, however, the wheel is too heavy to be actuated by hand at the beginning of rotation, particularly, when a tie rod for converting the reciprocal motion of the arms into rotation of the shaft is at a dead point. In view of this disadvantage, in some other conventional exercisers, the wheel is provided with a large number of vanes which are used as load resistance means by virtue of the resistance of air caused upon rotation of the wheel. However, a problem with such an exerciser is that a great deal of noise is caused by the wind generated by rotation of the vanes.

OBJECT AND SUMMARY OF THE INVENTION

It is therefore an object of the present invention to provide an exerciser with which one can stop the motion of the legs at any time even while the handle bars are in motion and which enables an easy start of exercise even when actuated solely by motion of the arms.

In order to achieve the foregoing object, an exercise bike provided in accordance with the present invention includes a frame, a saddle fixed to the frame, a loading means acting upon a flywheel rotatably mounted on the frame, a pedal shaft which is rotatably mounted to the frame and is coupled so as to be rotated by pedal cranks to which respective pedals are fixed, an intermediate shaft which is rotatably mounted to the frame and is coupled to a pair of cranks extending in the opposite axial directions that at the right and left sides of the frame, respectively, a pair of handle bars each pivotally mounted to the lower front part of the frame at the right and left sides of one end of the frame, a rotation transmitting means provided with a one-way clutch for transmitting only one directional rotation of the pedal shaft to the intermediate shaft, a pair of levers connected by one end thereof to opposite ends of the intermediate shaft at different relative angular positions, respectively, and a pair of connection rods for pivotally connecting an intermediate part of the handle bars and the other end of the levers so that the swinging motion of the handle bars is transmitted to the intermediate shaft and converted into rotational movement of the intermediate shaft and further into rotation of the flywheel.

That is, with the exercise bike of the present invention, rotation of a pedal shaft which supports pedal cranks for transmitting motion of legs is transmitted to an intermediate shaft through a one-way clutch and the intermediate shaft, handle bars, and flywheel are connected to each other.

Further, as a means for exerting a braking load on the flywheel, an assembly utilizing eddy currents generated by magnets makes the initial resistance at the start of actuation low and increases the braking load as the rotating speed of the wheel increases.

The exerciser provided in accordance with the present invention, as described above, operates as follows:

Movements of the flywheel, intermediate shaft, and handles are completely conjoined with each other. That is, the flywheel is rotated when the handles are moved and also the handles can be moved by the force of the rotating flywheel. Rotation of the pedals, however, is transmitted to the intermediate shaft through the one-way clutch. Accordingly, rotation of the intermediate shaft is not transmitted directly to the pedals. With such a structure, then, motion of the legs can be terminated at any time, even while the handle bars are being moved.

The apparatus of the present invention has the following technical advantages:

(1) Because a pedal shaft and an intermediate shaft for transmitting motion of the legs and arms, respectively, are provided so as to be independent from each other and connected by a one-way clutch, a cessation of motion of the legs is possible even while the arms are in motion.

(2) The pedal shaft and the intermediate shaft are coupled to one another through sprockets having the same number of teeth and thus legs and arms can be kept in synchronous motion at all times. Further, because a one-way clutch is provided, the legs and arms can be selectively exercised.

(3) Because the loading means of the type utilizing eddy currents, noise during rotation of the wheel is less than that of a structure utilizing air resistance. Further, it is possible for a light load to be applied at the initiation of exercise and a smooth increase in load in proportion to the increase of rotation speed of the flywheel. The amount of load, furthermore, can be changed and in fact, operation can be changed by remote control.

DESCRIPTION OF THE PREFERRED EMBODIMENT

An embodiment of the invention will now be described with reference to the accompanying drawings.

Figure 1:
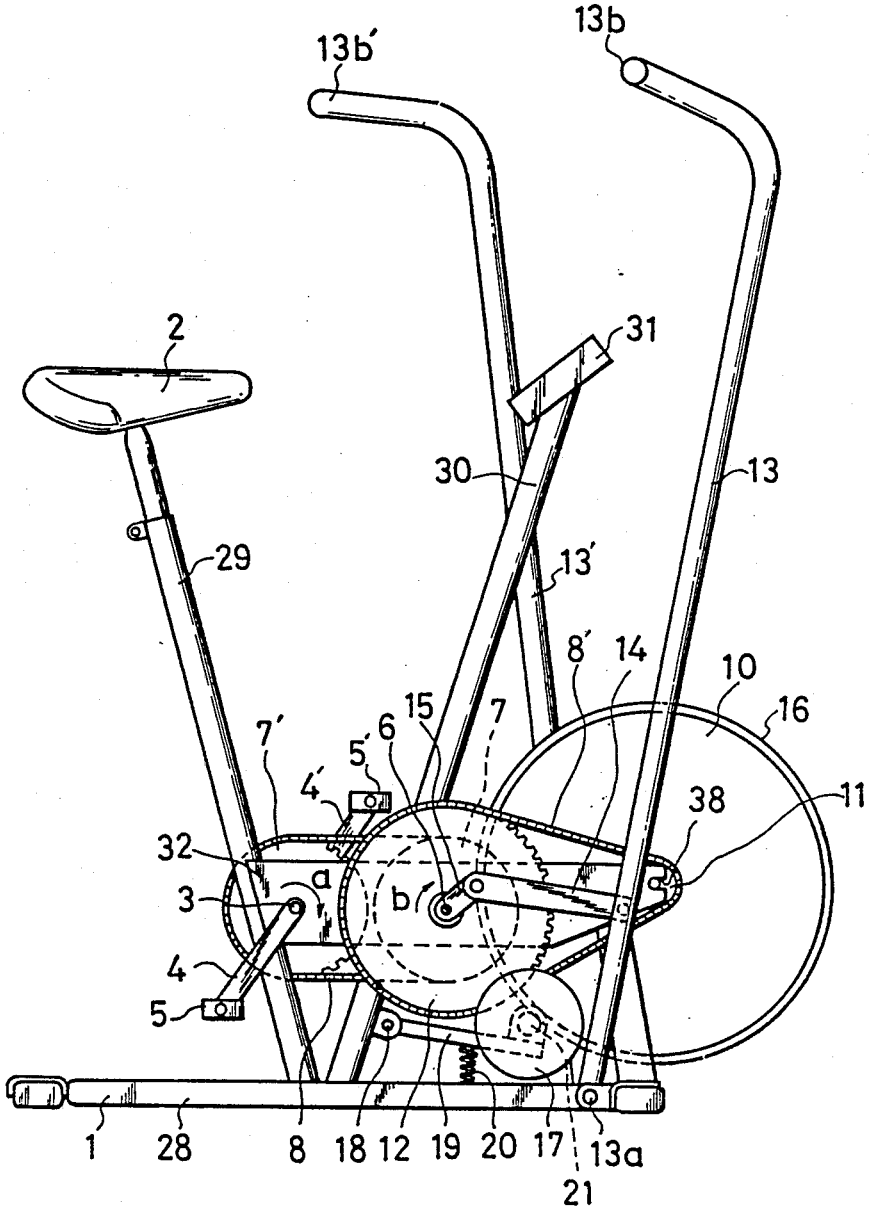
FIG. 1 is a side elevational view of an exercise bike in accordance with an embodiment of the present invention.
Figure 2:
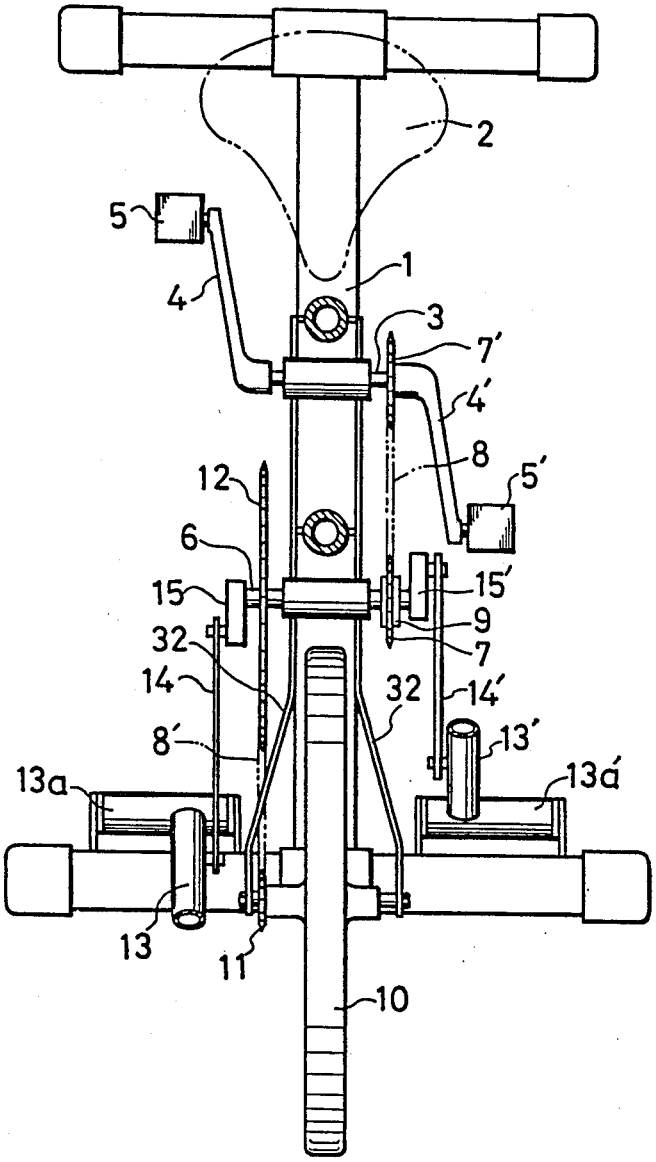
FIG. 2 is a top plan view of the exercise bike of FIG. 1, with some portions omitted for clarity.

Referring to FIGS. 1 and 2, a saddle 2 is fixed to frame 1 at the rear upper portion thereof by a stand pipe 29. A pedal shaft 3 is rotatably mounted to frame 1 so as to be located slightly ahead of and below saddle 2 and so as to jut out from the frame 1 to the right and to the left. Right and left pedal cranks 4, 4' are fixed to either end of pedal shaft 3 and right and left pedals 5, 5' are rotatably mounted, respectively, so that the treading force of the legs may be transmitted to pedal shaft 3 for rotation of the same.

An intermediate shaft 6 is rotatably mounted to frame 1 at a position ahead of pedal shaft 3. Pedal shaft 3 is fixed with a medium-sized sprocket 7' for transmitting rotation of pedal shaft 3 to the intermediate shaft 6 through a chain 8. Intermediate shaft 6 is fitted another medium-sized sprocket 7 through a one-way clutch 9 so that the normal direction of rotation (shown by arrow a) is transmitted to the intermediate shaft 6 but rotation in the opposite direction is not transmitted to shaft 6.

A flywheel 10 is rotatably is mounted to frame 1 ahead of intermediate shaft 6. The rotation of intermediate shaft 6 is transmitted to flywheel 10 through a chain 8' which extends between a small sprocket 11 fixed to flywheel 10 and a large sprocket 12 fixed to intermediate shaft 6.

Right and left handle bars 13, 13', respectively, are pivotally mounted to the lower most front portion of frame 1 and connection rods 14, 14' are pivotally mounted at one end thereof to intermediate parts of respective handle bars 33, 33'. Right and left cranks 15, 15' are fixed to the outer most ends of intermediate shaft 6 and extend perpendicular from shaft 6 in opposite directions to one another. The other end of connection rods 14, 14' are pivotally mounted to the outer ends of cranks 15, 15'.

Figure 3:
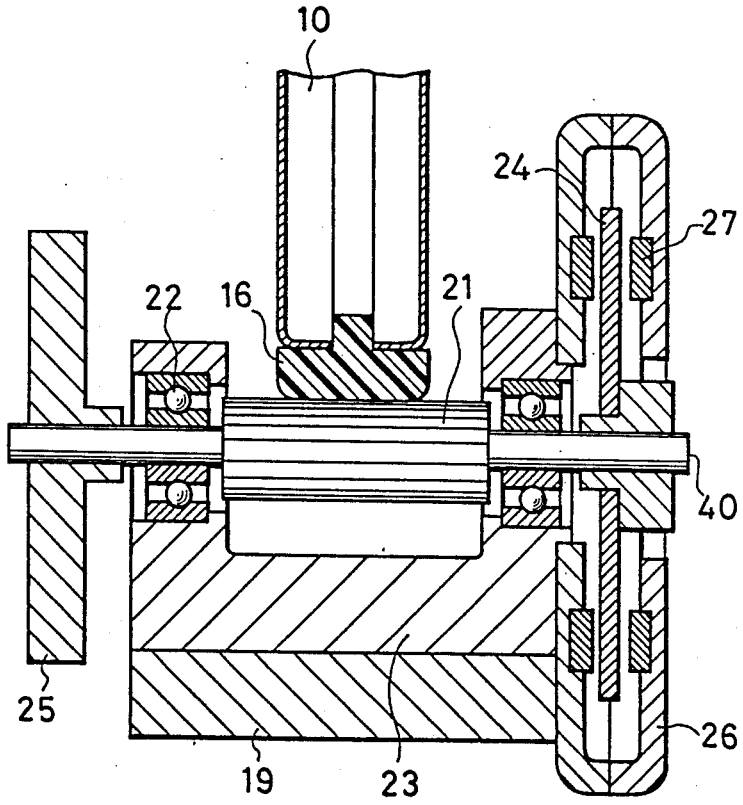
FIG. 3 is a sectional front view of loading means provided in accordance with the invention.

The outer periphery of flywheel 10 is provided with an elastic body 16 of molded material such as rubber which is wound around the periphery as shown in FIG. 3.

A loading means 17 is pressed to the outer periphery of flywheel 10. Loading means 17 is mounted to an arm 19 which is pivotally mounted by a pin 18 to frame 1. A small roller 21 of loading means 17 is urged into engagement with the elastic body 16 by a spring 20 which is inserted between arm 19 and frame 1.

An embodiment of the loading means provided in accordance with the present invention is shown in particular in FIG. 3.

A rotating shaft of roller 21 which is pressed against elastic body 16 on the periphery of flywheel 10 is rotatably held by bearings 22 in a housing 23 of the load means. A conductor 24 made of conductive material such as aluminum is fixed to one end of the rotating shaft 40 of the roller 21 and a small flywheel 25 is fixed to the other end, in which the conductor disc and small flywheel 25 are rotated by rotation of roller 21.

Housing 23 is fixed to arm 19 and has a cover 26 at the end thereof. Several magnets 27 are fixed to the inside wall of cover 26 in close proximity to a surface of conductor disc 24.

Frame 1, itself, includes a base 28 which is substantially I-shaped and has two upright pipes 29, 30 which extend upwardly from the center of base 28. Saddle 2 and a meter-panel 31 for supporting instruments such as a speedometer, are fixed to the upper ends of upright pipes 29, 30, respectively.

A pair of vertical side plates 32 extend horizontally so as to support the two upright pipes, support the bearing for pedal shaft 3, and a bearing for intermediate shaft 6, and a notch 38 at the front ends thereof support a bearing for the shaft of flywheel 10.

The exercise bicycle described above operates as follows:

Upon rotation of pedals 5, 5' by means of the user's feet, pedal shaft 3 and medium-sized sprocket 7' are rotated in direction a. This rotational movement is transmitted to the medium-sized sprocket 7 through chain 8 and drives intermediate shaft 6.

If, on the other hand, pedal shaft 3 is rotated by the user's feet in a direction opposite to direction a, rotation is transmitted to intermediate sprocket 7, but not to intermediate shaft 6 because one-way clutch 9 is interposed between medium-sized sprocket 7 and intermediate shaft 6. Accordingly, only rotational movement in the direction a will be transmitted to intermediate shaft 6 and only motion of pedal cranks 4, 4' in the direction a moves the handle bars as described more fully below.

In order to exercise the arms, respective ends 13b, 13b' of handle bars 13, 13' are pushed and pulled by the hands. Cranks 15, 15' are rotated by rods 14, 14' and rotate intermediate shaft 6.

Since right and left cranks 15, 15' extend from both ends of intermediate shaft 6 in directions substantially opposite to one another, the right handle 13 leans forward when left handle 13' leans backward. Thus, the two handles move in directions opposite to one another. Thus, the arms can be exercised by pushing one handle and pulling the other handle and a well-balanced exercise of the arms is possible.

Movement of handle bars 13, 13' are in conjoint relation with intermediate shaft 6 through rods 14 and 14'. Rotation of intermediate shaft 6 is transmitted to flywheel 10 at an increased rate by large and small sprockets 12 and 11, respectively. Rotation is then transmitted to roller 21 of loading means 17 which is in contact with the outer peripheral of flywheel 10 at a further increased rate, the rotation energy being absorbed by loading means 17.

Motion of the arms conjoin with rotation of flywheel 10 can be smoothly performed while easily surmounting a dead point caused when crank 15 and rod 14 lie on a common straight line due to the opposite direction motion of crank 15 by the rotational inertia of flywheel 10.

Motion of the arms can be simultaneous with motion of the legs and exercise of the arms can be assisted by the legs. However, when motion of the arms rotates the intermediate shaft 6 in direction b, rotation of intermediate shaft 6 is not transmitted to pedal shaft 3 due to the provision of one-way clutch 9. Therefore, motion of the legs can be stopped. However, when the motion of the arms rotation the intermediate shaft 6 in the direction opposite to direction b, rotation of intermediate shaft 6 is transmitted to pedal shaft 3. Thus, rotation from intermediate shaft can be selectively transmitted to the pedals and is simply prevented by operating the handle bars 13, 13′ so that the intermediate shaft rotates in direction b.

When flywheel 10 is rotated by motion of the feet and arms, roller 21 which is pressed against the elastic portion of the outer periphery flywheel 10 rotates and conductor disc 24 rotates as well.

Magnets 27 are disposed near the surface of conductor disc 24 so that the conductor disc 24 is disposed therebetween. By arranging magnets 27 so that the poles thereof are in a N-S relation, the magnetic flux of the magnets crosses the conductor disc 24. High speed rotation of the conductor disc within the magnetic flux generates eddy current in the conductor disc 24 and provides a heavy load. The magnitude of the load is substantially proportional to the density of magnetic flux crossing the conductor disc 24 and can be varied by varying the magnetic flux density.

The magnetic flux density can be varied by changing the relative position of the magnets or by changing the distance between the magnets. Such an adjustment is possible by a hand-actuated remote control using a wire cable or the like during exercise activity.

Although the invention has been described in its preferred form with a certain degree or particularity, it is to be understood that the present disclosure of the preferred embodiment can be changed in the details of construction and the combination and arrangement of parts may be varied without departing from the spirit and scope of the invention as hereafter claimed.

We claim:

1. An exerciser comprising:

a frame;

a saddle fixed to said frame;

a loading means acting upon a fly wheel rotatably mounted on said frame and outer periphery of said fly wheel for exerting load thereon which includes a roller which is pressed to an elastic body forming said outer periphery of said fly wheel for exerting load on said fly wheel, a bearing rotatably supporting said roller, a conductor disc connected to said roller by a shaft common thereto and at least one pair of magnets each disposed immediately adjacent to both surfaces of said conductor disc in a manner to interpose said conductor disc therebetween, and utilizes eddy currents generated by the rotation of said conductor disc for loading on said flywheel;

a pedal shaft which is rotatably mounted to said frame and is coupled to be rotated by pedal cranks to which respective pedals are fixed;

an intermediate shaft which is rotatably mounted to said frame and is coupled to a pair of cranks extending in the opposite axial directions thereof at the right and left sides of said frame, respectively;

a pair of handle bars each pivotally mounted to the lower front part of said frame at the right and left sides of one end of said frame and, a rotation transmitting means provided with a one-way clutch for transmitting only one directional rotation of said pedal shaft to said intermediate shaft;

a pair of levers connected by one end thereof to opposite end of said intermediate shaft with different relative angular positions, respectively, a pair of connection rods for pivotally connecting an intermediate part of said handle bars and the other ends of said levers, so that the swing motion of the handle bars is transmitted to said intermediate shaft and converted into the rotational movement of said intermediate shaft, and further into rotation of said flywheel.

2. An exerciser as set forth in claim 1, wherein said pedal shaft and said intermediate shaft are provided with medium-sized sprockets having the same number of teeth, rotation of said pedal shaft is transmitted to said intermediate shaft by said medium-sized sprockets and a chain, and rotation of the intermediate shaft is transmitted to said fly wheel by a large sprocket of said intermediate shaft, a small sprocket of said fly wheel, and a chain.

3. An exerciser as set forth in claim 2, wherein said medium-sized sprockets are free wheeling sprockets.

* * * * *